United States Patent [19]

Lührsen et al.

[11] 4,268,015

[45] May 19, 1981

[54] BOTTOM OUTLET OR DISCHARGE FOR USE IN METALLURGICAL VESSELS FOR STEEL MELTS, PARTICULARLY TUNDISHES

[75] Inventors: Ernst Lührsen, Bad Schwalbach; Godehard Süssmuth, Marktredwitz; Klaus Walden, Buxtehude, all of Fed. Rep. of Germany

[73] Assignees: Didier-Werke AG, Wiesbaden; Hamburger Stahlwerke GmbH, Hamburg, both of Fed. Rep. of Germany

[21] Appl. No.: 11,569

[22] Filed: Feb. 12, 1979

[30] Foreign Application Priority Data

Feb. 20, 1978 [DE] Fed. Rep. of Germany ..... 2807123

[51] Int. Cl.[3] ..... C21C 7/00

[52] U.S. Cl. ..... 266/236; 266/280; 266/283; 266/285; 266/286

[58] Field of Search ..... 266/236, 280, 281, 283, 266/285, 286

[56] References Cited

U.S. PATENT DOCUMENTS 3,203,689 8/1965 Hallowell ..... 266/286

*Primary Examiner*—R. Dean

*Attorney, Agent, or Firm*—Wenderoth, Lind & Ponack

[57] ABSTRACT

A bottom outlet or discharge for metallurgical vessels includes a sleeve brick, a nozzle brick positioned in the sleeve brick, the nozzle brick having therethrough a discharge opening, and a highly wear-resistant tubular sleeve fitted within the discharge opening of the nozzle brick. The sleeve brick, the nozzle brick and the sleeve are formed of materials such that they have thermal expansions at 1400° C. of from 1.0 to 1.15%, from 0.5 to 0.8% and from 1.1 to 1.25%, respectively.

8 Claims, 2 Drawing Figures

BOTTOM OUTLET OR DISCHARGE FOR USE IN METALLURGICAL VESSELS FOR STEEL MELTS, PARTICULARLY TUNDISHES

BACKGROUND OF THE INVENTION

The present invention relates to a bottom outlet or discharge for metallurgical vessels receiving smelted steel, particularly tundishes, wherein a sleeve brick has inserted therein a nozzle brick, and wherein there is provided a heat insulating layer covering the sleeve brick and at least the area of the discharge.

Metallurgical vessels to receive steel melts, particularly such as tundishes, have a fire-resistant lining of bricks connected with mortar and a fire-resistant substance. In the bottom of the vessel, the bottom outlet or discharge is formed by a sleeve brick and a nozzle brick of wear-resistant material inserted within the sleeve brick. When it becomes necessary to replace a used nozzle brick, it is generally also then necessary to replace the sleeve brick, and thus a reformed fire-resistant substance is primarily used between the brick work of the lining and the sleeve brick. German Gebrauchsmuster 76 19 744 discloses a heat-insulating lining provided on top of the permanent fire-resistant lining in a decanting vessel for liquid metal, whereby a reduced preheating or the elimination of preheating, a better protection of the permanent lining and the possibility of convenient cleaning of the vessel are achieved. Further, the heat-insulating lining can cover the sleeve brick at the discharge and can extend to the nozzle brick. This is done in order to obtain the advantage that the durability of the sleeve brick is increased and so that the sleeve brick can be fitted directly to the fire-resistant brickwork without using therebetween a fire-resistant substance.

However, in practice, it has been found, when employing such a bottom outlet or discharge in metallurgical vessels, that during operation not only the nozzle brick but also the sleeve brick which is protected by the heat insulating layer is highly stressed, and that after wear of the nozzle brick sufficient to require replacement thereof, it is also necessary to replace the sleeve brick since it has been destroyed due to the formation of cracks. It has specifically been found that safe operation of the metallurgical vessel cannot be achieved, for example, with a nozzle brick formed on the basis of zirconium silicate, and particularly of zirconium oxide, and a sleeve brick on the basis of calcined bauxite with clay bonding.

SUMMARY OF THE INVENTION

With the above discussion and background in mind, it is the object of the present invention to provide a bottom outlet or discharge of the general type referred to above, but wherein the durability of the discharge or outlet and the durability of the fire-resistant lining in the area of the discharge or outlet are improved, and wherein the time required for the repair of the discharge or outlet is reduced.

This object is achieved in accordance with the present invention by the provision of a bottom outlet or discharge for use in metallurgical vessels for steel melts, particularly tundishes, wherein the bottom outlet or discharge includes a sleeve brick, a nozzle brick positioned within the sleeve brick, the nozzle brick having therethrough a discharge opening, and a highly wear-resistant tubular sleeve fitted within the discharge opening of the nozzle brick. The sleeve brick, the nozzle brick and the sleeve have thermal expansions at 1400° C. of from 1.0 to 1.5%, from 0.5 to 0.8% and from 1.1 to 1.25% respectively. Preferably, the thermal expansions at 1400° C. of the sleeve brick, the nozzle brick and sleeve are 1.1%, 0.6% and 1.2%, respectively.

The sleeve brick may be an alumina-rich brick fired at a temperature of 1600° C. and containing 75 to 90 percent by weight $Al_2O_3$ of tabular alumina and a matrix of mullite and corundum, or a chromium magnesite or chromite brick.

A fired material on the basis of zirconium silicate or a fired alumina-rich brick with 50 to 70 percent by weight $Al_2O_3$ are particularly suitable as the nozzle brick.

The sleeve is advantageously formed of a fired material on the basis of zirconium oxide or magnesium oxide.

A preferable arrangement of the bottom outlet or discharge involves a sleeve brick formed of an alumina-rich material, a nozzle brick formed of zirconium silicate, and a sleeve formed of zirconium oxide.

In accordance with a further feature of the present invention, the inner diameter of the sleeve is larger than the diameter of the discharge opening in the nozzle brick in the area thereof immediately above the sleeve, and the inner, upper rim or edge of the sleeve is rounded. By the provision of these specific structural features, it is possible to avoid undesirable one-sided washing-out during use, thereby providing a uniform erosion profile across the overall section of the bottom outlet or discharge.

By the above structural features of the present invention, there is provided a bottom outlet or discharge wherein the sleeve brick may be inserted within the fire-resistant brickwork of the vessel and will remain in a safe operational condition for a much longer time than in prior art arrangements. Specifically, the same sleeve brick may be employed throughout the life of several nozzle bricks. Further, the nozzle brick is tightly fitted with the sleeve, but without the formation of harmful stresses. Thus, the overall bottom outlet or discharge has a much higher durability than prior art outlets or discharges. The nozzle brick is advantageously provided with a conical outer configuration and can thus easily be removed when in a cooled-down state from the sleeve brick and can easily be replaced therein by a new sleeve brick without requiring expensive and time consuming repair operations. The generally improved durability of the bottom outlet or discharge is the result of the utilization of the above noted materials for the various parts of the outlet or discharge, and particularly to the formation of such parts of materials to have the above noted respective thermal expansions. These features reduce the stresses to which the various parts of the outlet or discharge are subjected and therefore increase the overall durability of the outlet or discharge.

BRIEF DESCRIPTION OF THE DRAWINGS

The above and other objects, features and advantages of the present invention will be more apparent from the following detailed description, taken with the accompanying drawings, wherein.

DETAILED DESCRIPTION OF THE INVENTION

Figure 1:
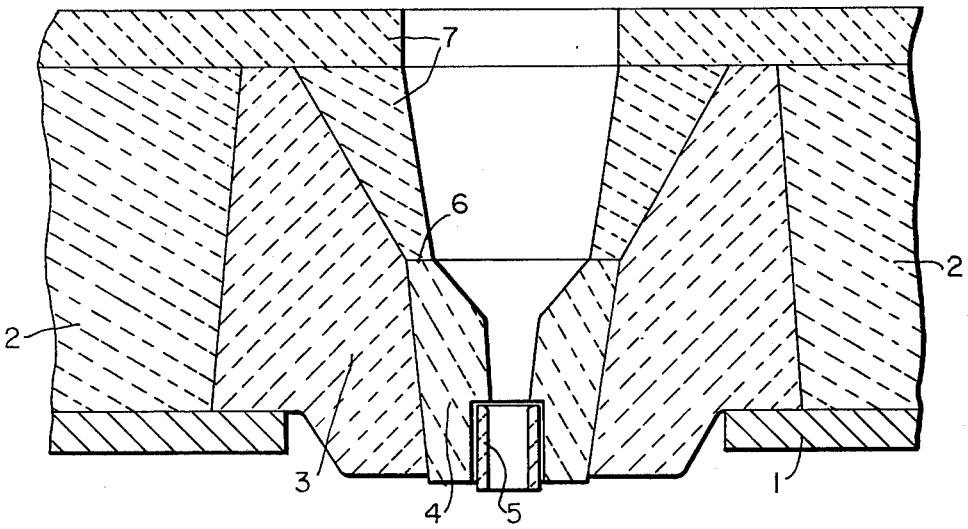
FIG. 1 is a cross-section through a portion of the bottom of a metallurgical vessel equipped with a bottom outlet or discharge in accordance with the present invention.

With reference now to the drawings, there is shown in FIG. 1 a portion of the bottom of a metallurgical vessel including a fire-resistant brickwork lining 2 supported by a metallic jacket 1. The bottom outlet or discharge extends through the lining 2 and the jacket 1 and includes, in accordance with the present invention, sleeve brick 3, a nozzle brick 4 having therethrough a discharge opening, and a highly wear-resistant tubular sleeve 5 fitted within the discharge opening of the nozzle brick 4. The various elements of the bottom outlet or discharge are, in a known manner, connected with each other by employing a conventional fire-resistant cement applied in a thin layer (not shown). The fire-resistant lining 2 and the sleeve brick 3 are covered by a heat-insulating layer 7 up to the upper edge 6 of the nozzle brick 4.

Figure 2:
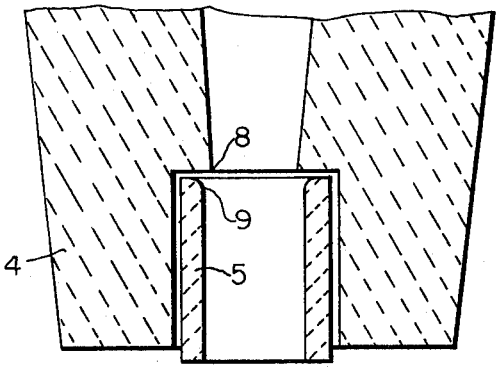
FIG. 2 is an enlarged partial section of a portion of the bottom outlet or discharge shown in FIG. 1.

As shown in FIG. 2 of the drawings, the inner diameter of the sleeve 5 is larger than the diameter of the discharge opening in the nozzle brick 4 in the area 8 above the sleeve 5. Also, the inner, upper edge 9 of the sleeve 5 is rounded. The structural features provide for uniform erosion throughout the entire section of the outlet or discharge during use.

The sleeve brick 3, the nozzle brick 4 and the sleeve 5 have thermal expansions at 1400° C. of from 1.1 to 1.15%, from 0.5 to 0.8% and from 1.1 to 1.25%, respectively. Preferably, these thermal expansions are 1.1%, 0.6% and 1.2%, respectively.

The sleeve brick 3 may be an alumina-rich brick fired at a temperature of above 1600° C. and containing 75 to 90 percent by weight of $Al_2O_3$ in the form of tabular alumina and a matrix of mullite and corundum. The sleeve brick 3 may also comprise a fired chromium magnesite or chromite brick.

The nozzle brick 4 may be composed of a fired material on the basis of zirconium silicate. The nozzle brick 4 may also comprise a fired alumina-rich brick with 50 to 70 percent by weight $Al_2O_3$.

The sleeve may be composed of a fired material on the basis of zirconium oxide or magnesium oxide.

The following Example is intended to be illustrative of a preferred embodiment of the bottom outlet or discharge according to the present invention. However, this Example is not intended to be limiting to the present invention, as other compositions of the materials of the various parts of the bottom outlet or discharge of the present invention will be apparent to those skilled in the art.

EXAMPLE

Sleeve brick 3 is a brick with 80 percent by weight $Al_2O_3$ of tabular alumina with mullitic bonding, fired at a temperature above 1600° C.

Nozzle brick 4 is a zirconium silicate brick with 65 percent by weight $ZrO_2$.

Sleeve 5 is a brick of stabilized zirconium oxide with 96 percent by weight $ZrO_2$.

The sleeve 5 is inserted into the nozzle brick 4 by means of a fire-resistant cement on the basis of zirconium silicate with sodium silicate as a bonding agent. The nozzle brick 4 is connected to the sleeve brick 3 and the sleeve brick is connected to the fire-resistant brickwork lining 2 by means of a cement formed of corundum and a solution of monoaluminum phosphate as a binding agent.

The properties of the various elements of the bottom outlet or discharge are as follows:

| | Sleeve brick 3-80 percent by weight $Al_2O_3$ | Nozzle brick 4-65 percent by weight $ZrO_2$ 35 percent by weight $SiO_2$ | Sleeve 5-96 percent by weight $ZrO_2$ |
|---|---|---|---|
| Gross density ($g/cm^3$) | 2.85 | 3.70 | 4.40 |
| Open porosity (%) | 16 | 21 | 23 |
| Compressive strength ($N/mm^2$) | 120 | above 70 | 280 |
| Temperature change resistance - water quenching method | above 25 | above 20 | |
| Pressure-fire resistance-(°C.) | above 1720 | above 1700 | above 1750 |
| Thermal expansion at 1400° C. (%) | 1.1 | 0.6 | 1.2 |

Although the present invention has been described and illustrated with respect to specific structural and compositional features thereof, various modifications may be made thereto, as will be apparent to those skilled in the art, without departing from the scope of the present invention.

What is claimed is:

1. A bottom outlet or discharge for use in metallurgical vessels for steel melts, particularly tundishes, said bottom outlet or discharge comprising:

a sleeve brick;

a nozzle brick positioned within said sleeve brick, said nozzle brick having therethrough a discharge opening;

a highly wear-resistant tubular sleeve fitted within said discharge opening of said nozzle brick; and said sleeve brick, said nozzle brick and said tubular sleeve are formed of materials having thermal expansions at 1400° C. of from 1.0 to 1.15%, from 0.5 to 0.8% and from 1.1 to 1.25%, respectively.

2. A bottom outlet or discharge as claimed in claim 1, wherein said thermal expansions at 1400° C. of said materials of said sleeve brick, said nozzle brick and said tubular sleeve are 1.1%, 0.6% and 1.2%, respectively.

3. A bottom outlet or discharge as claimed in claim 1, wherein said sleeve brick comprises an alumina-rich brick fired at a temperature of above 1600° C. and containing 75 to 90% by weight of $Al_2O_3$ in the form of tabular alumina and a matrix of mullite and corundum.

4. A bottom outlet or discharge as claimed in claim 1, wherein said nozzle brick is composed of a fired material on the basis of zirconium silicate.

5. A bottom outlet or discharge as claimed in claim 1, wherein said tubular sleeve is composed of a fired material on the basis of zirconium oxide.

6. A bottom outlet or discharge as claimed in claim 1 wherein said sleeve brick is formed of an alumina-rich material, said nozzle brick is formed of zirconium silicate, and said tubular sleeve is formed of zirconium oxide.

7. A bottom outlet or discharge as claimed in claim 1, wherein the inner diameter of said tubular sleeve is larger than the diameter of said discharge opening in said nozzle brick at least in the area thereof closely above said tubular sleeve.

8. A bottom outlet or discharge as claimed in claim 7, wherein the inner, upper rim of said tubular sleeve is rounded.

* * * * *